United States Patent [19]

Mortvedt

[11] Patent Number: 4,561,655

[45] Date of Patent: Dec. 31, 1985

[54] TUBULAR STEEL RACQUET FRAME HAVING VARYING CROSS-SECTION

[75] Inventor: Raymond L. Mortvedt, Santee, Calif.

[73] Assignee: Ektelon, San Diego, Calif.

[21] Appl. No.: 620,639

[22] Filed: Jun. 14, 1984

[51] Int. Cl.[4] ..... A63B 49/12

[52] U.S. Cl. ..... 273/73 H; 273/73 C; 273/73 J

[58] Field of Search ..... 273/73 H, 73 C, 73 F, 273/73 R

[56] References Cited

U.S. PATENT DOCUMENTS

| | | | |
|---|---|---|---|
| 1,618,727 | 2/1927 | Reach | 273/73 H |
| 2,171,223 | 8/1939 | Robinson | 273/73 H |
| 3,086,777 | 4/1963 | Lacoste | 273/73 H |
| 4,299,348 | 11/1981 | Fukumoto | 273/73 H |

FOREIGN PATENT DOCUMENTS

| | | | |
|---|---|---|---|
| 39429 | 3/1977 | Japan | 273/73 H |
| 127037 | 11/1978 | Japan | 273/73 H |
| 1322606 | 7/1973 | United Kingdom | 273/73 H |

*Primary Examiner*—Richard C. Pinkham
*Assistant Examiner*—Matthew L. Schneider
*Attorney, Agent, or Firm*—Oldham, Oldham & Weber Co.

[57] ABSTRACT

A steel tubular frame design for racquetball racquets, has a varying cross-sectional structure. This structure gives strength in the lower portion of the racquet so as to reduce the torsional and flexional movements of the frame in that area and has a different cross-sectional area in the upper portion of the racquet where flexibility is needed, providing this flexibility in a continuous one-piece racquet. The invention is characterized by a four-sided peanut-shaped steel tube that has convex corners and two concave sides on the long sides. The convexity and concavity varying at different points throughout the racquet. The racquet frame is of a quadraform/w-ishbone configuration and is throatless.

3 Claims, 3 Drawing Figures

TUBULAR STEEL RACQUET FRAME HAVING VARYING CROSS-SECTION

TECHNICAL FIELD

The present invention herein described relates to the field of racquets, and particularly to tubular-framed steel racquets.

BACKGROUND ART

In the past, there have been racquet frames of tubular steel designs. However, these designs have not possessed the engineering expertise needed to reach the state-of-the-art. Also, racquets have been manufactured from numerous tubular materials. Further, most prior art racquets have been of a unitary cross-sectional design along the full length, which does not enable a racquet to have strength where strength is needed and to have flexibility, where flexibility is needed. This need is met by the present invention.

DISCLOSURE OF INVENTION

It is an aspect of the present invention to have a racquet frame manufactured from steel.

It is another aspect of the present invention to have increased strength in the portion of the racquet near the handle where the maximum flex must occur.

Still another aspect of the present invention is to increase the flexibility of the racquet frame in the upper portion of the racquet.

Yet another aspect of the present invention is to increase the overall durability of the racquet frame.

Still another aspect of the present invention is a varying cross-sectional configuration along the length of the racquet frame.

Yet another aspect of the invention is that the frame take a quadraform/wishbone shape and be throatless for longer string length.

These aspects and other aspects of the invention will become more apparent upon a reading of the preferred embodiments, which are achieved by: a racquet, the improvement comprising a continuous four-sided tubular steel frame wherein said frame is symmetric about its long axis, said frame having a width of about 0.279 to 0.307 inch, a height of about 0.490 to 0.510 inch, the first long side having a concave arc with a radius of about 0.018 to 0.126 inch from a point about 0.080 to 0.090 inch away from said frame's widest point along said line of symmetry, the second long side having an arc with a radius of about 0.260 to 0.355 inch from a point about 0.215 to 0.325 inch away from said frame's widest point along said axis of symmetry, both short sides having one end having convex arcs with a radius of about 0.118 to 0.128 inch from a point inside said tube frame about 0.122 to 0.132 inch vertically from said axis and about 0.118 to 0.128 inch from the widest point of said first long side, the other end of said short side having a convex arc with a radius of about 0.070 to 0.110 inch from a point inside said tube frame about 0.150 to 0.178 inch vertically from said axis and about 0.070 to 0.100 inch from the widest point of said second long side.

BEST MODE FOR CARRYING OUT THE INVENTION

Figure 1:
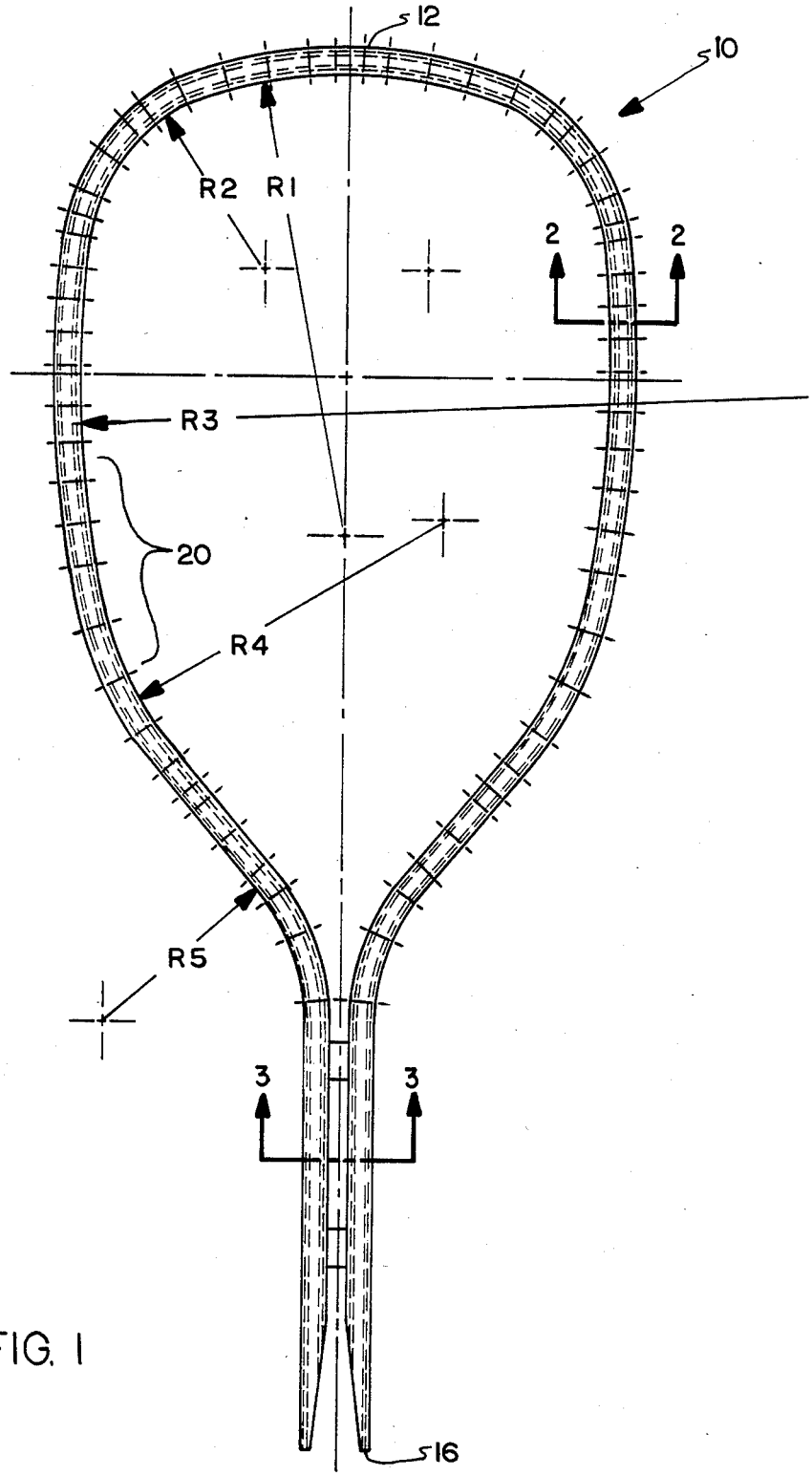
FIG. 1 is a top general view of the racquetball racquet.
Figure 2:
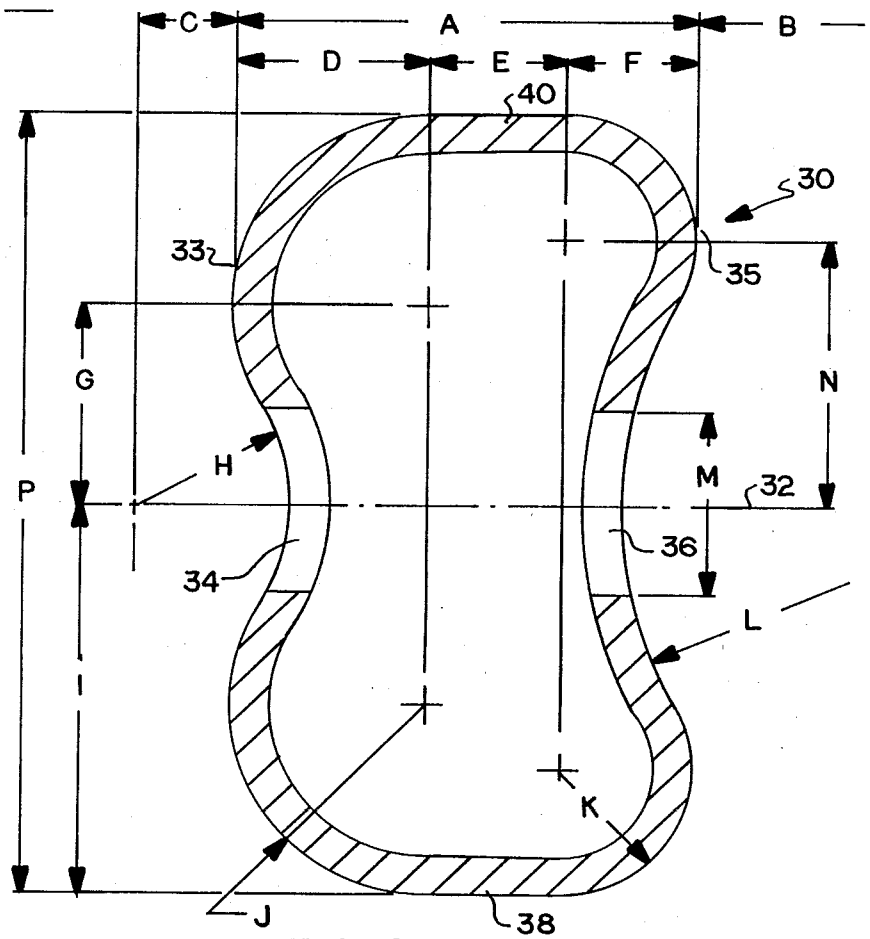
FIG. 2 is a cross-sectional view of the racquetball racquet frame at 2—2.
Figure 3:
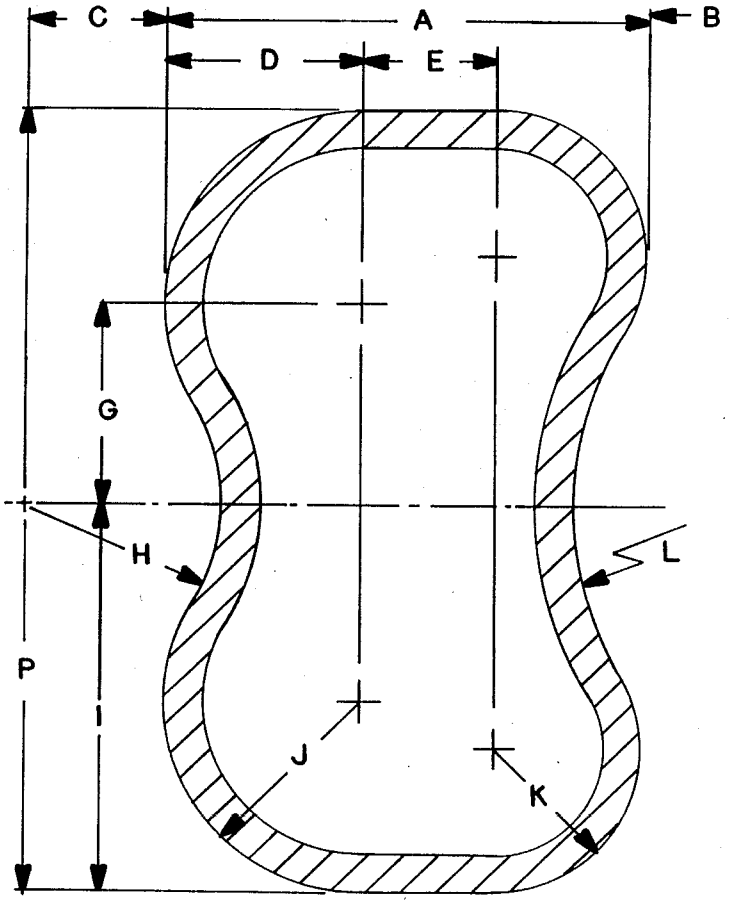
FIG. 3 is a cross-sectional view of the racquetball racquet frame at 3—3.

FIG. 1 illustrates a top view of the racquetball racquet 10. The overall length of the racquet is about 18.5 inches. As will be described hereinafter, FIG. 2 is a cross-sectional view taken in the upper portion of the racquet about 3.75 inches to 5 inches from the head of the racquet 12. FIG. 3 is a cross-sectional view of the racquet frame in the area about 10.5 inches to 11.75 inches from the base of the racquet handle bottom 16. The transitional area 20 is the area between the upper portion of FIG. 2 and the lower portion of FIG. 3 where the racquet frame changes design from FIG. 2 into FIG. 3.

FIG. 2 illustrates a cross-sectional view of the racquet frame at the point 2—2 of FIG. 1. The cross-section is of a somewhat peanut-shape, having four sides, convex corners, and concave mid-portions on the two long sides. The cross-section 30 is symmetric about its center axis 32. The cross-section 30 at its widest point, designated by length A, varies from about 0.279 inch to 0.307 inch, and its height is about 0.490 inch to 0.510 inch designated at length P. Preferably at cross-section 2—2, length A is about 0.286 inch and length P is about 0.500 inch. Hereinafter, the length P is designated as the long side and the length A as the short side to clarify the structure. The first long side 34 has a concave arc at the axis of symmetry 32. The arc has a radius of about 0.118 to 0.126 inch, identified as length H. It is located from a point about 0.080 to 0.090 inch designated as length C, away from the widest point, of the cross-section 33. Preferably, at cross-section 2—2, length C is about 0.086 inch and length H is about 0.122 inch. The other long side 36 has a concave arc at the axis of symmetry 32 which has a radius of about 0.260 to 0.355 inch, designated as length L, located from a point about 0.215 to 0.325 inch, designated as length B, from the widest point of the cross-sectional area 35. At cross-section 2—2, length L is preferably about 0.266 inch and length B is preferably about 0.220 inch. Both short sides 38/40 possess the same dimensions since they are symmetrical about the axis of symmetry 32. The short sides are formed at one end with a convex arc on the long side 34 with a radius of about 0.118 to 0.128 inch, designated as length J, located from a point inside the cross-sectional area at a distance of about 0.122 to 0.132 inch, vertically from the axis of symmetry 32 designated as length G, and at a point about 0.118 to 0.128 inch from the widest point of the cross-section 33, designated as length D. At cross-section 2—2, length J is preferably about 0.123 inch, length G is preferably about 0.127 inch, and length D is preferably about 0.123 inch. The other end of the short side has a convex arc radius of about 0.070 to 0.100 inch, designated as length K, located from a point inside the cross-sectional area located about 0.150 to 0.178 inch, away from the axis of symmetry 32, designated as length N, and about 0.070 to 0.100 inch from the widest point of the cross-section 35, designated as length F. At cross-section 2—2, the length K is preferably about 0.078 inch, length N is preferably about 0.172 inch, and length F is preferably about 0.078 inch. The cross-section at 2—2 gives the racquet maximum flexibility in that portion of the racquet, because the length L produces a smaller arc on the side of the frame towards the strings, further in conjunction with the smaller radius K on the edges of that arc forming the sides of the frame. These structural features, when contrasted with cross-section 3—3, allows the frame to bend and twist more readily, hence giving the flex needed in the hitting portion of the overall racquet frame.

FIG. 3 illustrates a cross-sectional view of the racquet at the point 3—3. The cross-section at 3—3 is of a similar design of that as at 2—2, however, the preferred dimensions vary from that at cross-section 2—2. Thus, for sake of repetition, one will be directed to the designated lengths in FIG. 2 designated as A', B', etc. The preferred lengths of section 3—3 are shown in Table I.

TABLE I

| | |
|---|---|
| Length A' | .300 inch |
| Length B' | .319 inch |
| Length C' | .086 inch |
| Length D' | .123 inch |
| Length F' | .092 inch |
| Length G' | .127 inch |
| Length H' | .122 inch |
| Length J' | .123 inch |
| Length K' | .092 inch |
| Length L' | .348 inch |
| Length N' | .158 inch |

The cross-section 3—3 has the dimensions herein described so as to increase the strength of the racquetball racquet in the lower portion of the racquet where strength is needed. This design increases the stiffness while decreasing the flexional and torsional responses that are not wanted at the lower handle portion of the racquet.

The thickness of the tube frame varies from about 0.018 to about 0.026, preferably a thickness of about 0.022 inch. The frame is preferably manufactured out of a steel material, however, could be manufactured out of a number of metallic substances, provided mechanical properties permit.

It is obvious that the racquetball racquet described herein can be modified in size, shape, and design, without departing from the spirit of the invention disclosed herein. Therefore, for a true understanding of the invention, reference should be had to the appended claims.

What is claimed is:

1. A racquet having a head and a handle comprising: a continuous tubular steel frame having, in cross-section, a generally four sided configuration that is symmetrical about its minor axis, the four sides of said frame comprising first and second long sides which are opposite each other, two short sides which are opposite each other, and convex rounded corners connecting adjacent sides, a cross-section of said frame having a width of about 0.279 to 0.307 inch at its widest point, a height of about 0.490 to 0.510 inch, the first long side having a concave arc with a radius of about 0.118 to 0.126 inch from a point about 0.080 to 0.090 inch away from said frame's widest point along the axis of symmetry, the second long side having an arc with a radius of about 0.260 to 0.355 inch from a point about 0.215 to 0.325 inch away from said frame's widest point along said axis of symmetry, both short sides being connected to said first long side via convex rounded corners having a radius of about 0.118 to 0.128 inch from a point inside said tube frame about 0.122 to 0.132 inch from said axis of symmetry in a direction toward the respective rounded corner and about 0.118 to 0.128 inch from the widest point of said first long side, both short sides being connected to said second long side via convex rounded corners having a radius of about 0.070 to 0.110 inch from a point inside said tube frame about 0.150 to 0.178 inch from said axis of symmetry in a direction toward the respective rounded corner and about 0.070 to 0.100 inch from the widest point of said second long side.

2. The racquet as recited in claim 1 wherein the cross-section of said frame at a point about 3.75 to 5.00 inches from the top of said head toward said handle has a width at its widest point of about 0.279 to 0.293 inch, said frame's first long side has a concave arc with a radius of about 0.122 inch from a point about 0.086 inch away from said frame's widest point on said axis of symmetry, said second long side has a concave arc with a radius of about 0.266 inch from a point about 0.220 inch away from said frame's widest point along the axis of symmetry, both short sides being connected to said first long side via convex rounded corners having a radius of about 0.123 inch from a point inside said tube frame at 0.127 inch from said axis of symmetry toward the respective rounded corner and 0.123 inch from the widest point of said first long side, both short sides being connected to said second long side via convex rounded corners having a radius of about 0.078 inch from a point inside said tube frame about 0.172 inch from said axis of symmetry toward the respective rounded corner and 0.078 inch from the widest point of said second long side.

3. The racquet as recited in claim 2 wherein the cross-section of said frame at a point about 10.50 to 11.75 inches from the handle end towards the head has a width at its widest point of about 0.293 inch to 0.307 inch, said frame's first long side has a concave arc with a radius of about 0.122 inch from a point about 0.086 inch away from said frame's widest point along said axis of symmetry, said second long side has a concave arc with a radius of about 0.348 inch at a point about 0.319 inch away from said frame's widest point along said axis of symmetry, both short sides being connected to said first long side via convex rounded corners having a radius of about 0.123 inch from a point on the inside of said tube frame of about 0.127 inch from said axis of symmetry toward the respective rounded corner and about 0.123 inch from the widest point of said first long side, both short sides being connected to said second long side via convex rounded corners having a radius of about 0.092 inch from a point inside said tube frame of about 0.158 inch from said axis of symmetry towards the respective rounded corner and about 0.092 inch from the widest pont of said second long side.

* * * * *